US011253886B2

(12) United States Patent
Cibulski

(10) Patent No.: US 11,253,886 B2
(45) Date of Patent: Feb. 22, 2022

(54) HYDROMECHANICAL DISPLAY DEVICE

(71) Applicant: Anthony Cibulski, Birmingham, AL (US)

(72) Inventor: Anthony Cibulski, Birmingham, AL (US)

( * ) Notice: Subject to any disclaimer, the term of this patent is extended or adjusted under 35 U.S.C. 154(b) by 0 days.

(21) Appl. No.: 16/186,554

(22) Filed: Nov. 11, 2018

(65) Prior Publication Data

US 2020/0156102 A1 May 21, 2020

(51) Int. Cl.

| | |
|---|---|
| ***B05B 17/08*** | (2006.01) |
| ***F21S 10/00*** | (2006.01) |
| *F21V 9/08* | (2018.01) |
| *F21Y 115/10* | (2016.01) |
| *F21W 121/02* | (2006.01) |

(52) U.S. Cl.

CPC ..... *B05B 17/085* (2013.01); *F21S 10/002* (2013.01); *F21V 9/08* (2013.01); *F21W 2121/02* (2013.01); *F21Y 2115/10* (2016.08)

(58) Field of Classification Search

CPC .. B05B 17/085; F21S 10/002; F21Y 2115/10; F21V 9/08; F21W 2121/02

USPC ..... 239/17–23

See application file for complete search history.

(56) References Cited

U.S. PATENT DOCUMENTS

| | | | | | |
|---|---|---|---|---|---|
| 1,490,833 | A * | 4/1924 | Kling | B05B 17/08 | 239/21 |
| 3,570,765 | A * | 3/1971 | de Gast | B05B 17/08 | 239/21 |
| 3,874,589 | A * | 4/1975 | Yamada | B05B 17/08 | 239/21 |
| 5,161,740 | A * | 11/1992 | Kuykendal | B05B 1/10 | 239/17 |
| 5,617,657 | A * | 4/1997 | Kahn | G09F 13/24 | 239/17 |
| 8,157,192 | B2 * | 4/2012 | Claas | B05B 3/14 | 239/588 |
| 2002/0113138 | A1 * | 8/2002 | Shih | B05B 17/08 | 239/17 |
| 2010/0001092 | A1 * | 1/2010 | Kloppenberg | C02F 1/505 | 239/20 |

* cited by examiner

*Primary Examiner* — Christopher S Kim

(57) ABSTRACT

A hydromechanical display device includes a reservoir, a pump, an upper pressure chamber, a plug-in receptacle containing a plug-in variable pressure module, a control valve, and a lower channel, including a constant pressure compartment and a variable pressure compartment.

15 Claims, 15 Drawing Sheets

HYDROMECHANICAL DISPLAY DEVICE

FIELD OF THE INVENTION

The present invention relates to table top hydromechanical display device that undergoes cycles in function. The central feature of the invention is a plug-in-chassis in to which the observer may plug in a variety of unique modules with various hydromechanical effects and auditory frequencies. Thus, observer interest is maintained and apathy and disinterest abandoned.

BACKGROUND OF THE INVENTION

In an era of extreme stress and insane chaos, the demand for anxiolytics, anti-depressants and insomniolytics has increased at an alarming rate. Therefore, there have been efforts made in the development of non-pharmaceutical strife liberating approaches to conquer these personal burdens. Hydromechanical displays have been developed for providing a serene and relaxing visual and audial effect for the user.

Conventional water displays, such as those designed for a desk or table top, are non-dynamic and unchanging, resulting in eventual apathy and disinterest. These conventional water displays often lack illumination and mechanical displays as well as changing water patterns and therefore, produce the same auditory frequencies.

Moreover, with conventional water displays, the user cannot control the devices operation beyond turning the water pump on or off. There are typically no options for changing the display or providing different effects simply and conveniently.

As can be seen, there is a need for an improved table or desk top water display ornament that has the ability to provide multiple visual and audial effects for the user.

SUMMARY OF THE INVENTION

The disclosure provides a table or desk top device that is structured around a plug-in-chassis, whereby a variety of hydromechanical displays can be inserted either individually or in concert with each other. The plug-in-chassis can include a central reservoir having a pump disposed therein. The floor of the central reservoir can include a constant pressure compartment and a variable pressure compartment lying adjacent to each other or in any other convenient configuration. These compartments can accommodate a variety of plug-in modules that are designed for either a constant or a variable pressure source. Using easily accessible valves, a user can control the volumetric flow, the speed and the cycle period of the plug-in modules. A curtain of cavitation bubbles within the reservoir can be used to camouflage the unsightly hardware (pump and tubing) in the reservoir. The cavitation bubbles are brilliantly illuminated by laser like LEDs and offer a significant contribution of appearance and sound to the aesthetics of the display.

These and other features, aspects and advantages of the present invention will become better understood with reference to the following drawings, description and claims. The potential for expansion to functional artfully crafted curvilinear ornaments should be appreciated.

BRIEF DESCRIPTION OF THE DRAWINGS

The present disclosure, in accordance with one or more various embodiments, is described in detail with reference to the following figures. The drawings are provided for purposes of illustration only and merely depict exemplary embodiments of the disclosure. These drawings are provided to facilitate the reader's understanding of the disclosure and should not be considered limiting of the breadth, scope, size, or applicability of the disclosure. It should be noted that for clarity and ease of illustration these drawings are not necessarily made to scale.

DETAILED DESCRIPTION OF THE EMBODIMENTS

The following description is presented to enable a person of ordinary skill in the art to make and use embodiments described herein. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the disclosure. Thus, the present disclosure is not intended to be limited to the examples described herein and shown, but is to be accorded the scope consistent with the claims.

It should be understood that the specific order or hierarchy of steps in the process disclosed herein is an example of exemplary approaches. Based upon design preferences, it is understood that the specific order or hierarchy of steps in the processes may be rearranged while remaining within the scope of the present disclosure. Any accompanying method claims present elements of the various steps in a sample order, and are not meant to be limited to the specific order or hierarchy presented.

The disclosure provides a table top hydromechanical display device that is structured around a plug-in-chassis, whereby a variety of hydromechanical displays can be inserted either individually or in concert with each other. The intermingling of hydro and mechanical displays more readily captures the eye and maintains the interest of the observer than either one alone. When the displays undergo cycles in their function, observer fatigue can be delayed and interest maintained for repeat performances. Additionally, the observer has the option to design the overall display of the system. The observer can choose from a variety of uniquely different plug-in modules and determine their arrangement in the plug-in chassis.

Figure 1:
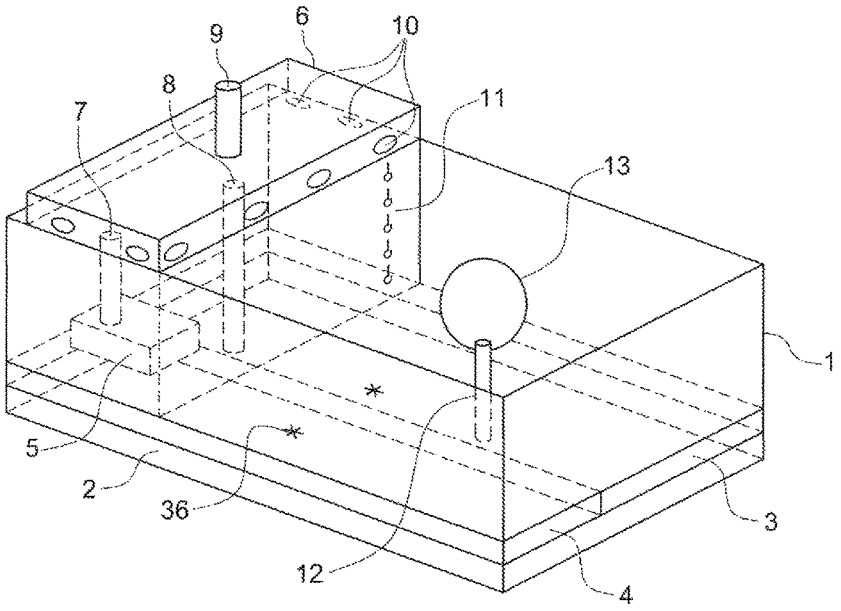
FIG. 1 illustrates an embodiment of a front, side view of a hydromechanical display device.

FIG. 1 illustrates a front, side view of a hydromechanical display device. As shown in this figure, the device includes a reservoir 1 for holding a liquid such as water and the like. The reservoir can be of any size or shape, made of any suitable materials including but not limited to a glass or a plastic, and can be transparent, opaque, or any color. Disposed within the reservoir 1 is at least one pump 5 for pumping liquid held in the reservoir 1 throughout the device. Suitable pumps include but are not limited to a Beckett-22 amp-pump and the like.

The pump 5 can be used to propel liquid held in the reservoir 1 through pressure chamber tube 7 to an upper pressure chamber 6 disposed at a top surface of and above the reservoir. Further, a plug-in receptacle 9 for holding and/or securing a plug-in module (not shown), can be disposed above the upper pressure chamber 6. The upper pressure chamber 6 can include a plurality of openings or portals as shown on the front and sides of the bottom panel of the chamber 6. The portals 10 allow liquid present in the upper pressure chamber 6 to flow back to the reservoir 1, while providing a curtain of cavitation bubbles 11 within the flowing liquid.

A lower channel tube 8 allows for flow of excess liquid in the upper pressure chamber 6 into a lower compartment positioned on the floor of the reservoir 1. The lower compartments cover the entire floor of the reservoir 1 and are divided into two water tight compartments: a constant pressure compartment 3; and a variable pressure compartment 4. As shown in this figure, the lower channel tube 8 is connected to the constant pressure compartment 3. Compartments 3 and 4 can accommodate a variety of plug-in modules designed for either a constant or variable pressure source, respectively.

The constant pressure compartment 3 can deliver liquid to a reservoir fountain tube 12, which can extend upwards towards the surface of the reservoir liquid level (not shown). A sphere 13, or other suitable module, can be disposed at the end of the reservoir fountain tube 12. The sphere 13 can be of any size or shape and can be transparent, opaque, or any color. Additional receptacles or tubes in the lower compartments, i.e. compartments 3 and/or 4, are illustrated with the simplicity of a star 36.

The device can further include a panel of single or multi-colored sub-reservoir light emitting devices (LEDs) 2, which can brilliantly illuminate the cavitation bubbles 11 and can conceal the pump 5 and associated tubes, i.e., pressure chamber tube 7 and lower channel tube 8, and offers a significant contribution of appearance and sound to the aesthetics of the display.

Figure 2:
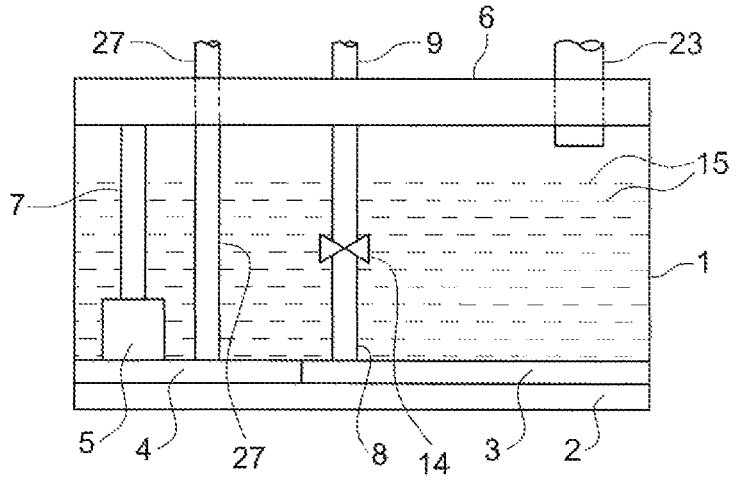
FIG. 2 illustrates an embodiment of a front view of a hydromechanical display device.

FIG. 2 illustrates a front view of a hydromechanical display device including the reservoir 1, the panel of sub-reservoir LEDs 2, the constant pressure compartment 3, the variable pressure compartment 4, the pump 5, the upper pressure chamber 6, the pressure chamber tube 7, the lower channel tube 8, the plug-in receptacle 9, and reservoir liquid 15 present in the reservoir. Control valve 14 located on the lower channel tube 8, can be used to control the relative flow of liquid into the lower channel tube 8 and the plug-in receptacle 9, both of which are supplied by liquid in the upper pressure chamber 6.

Figure 3:
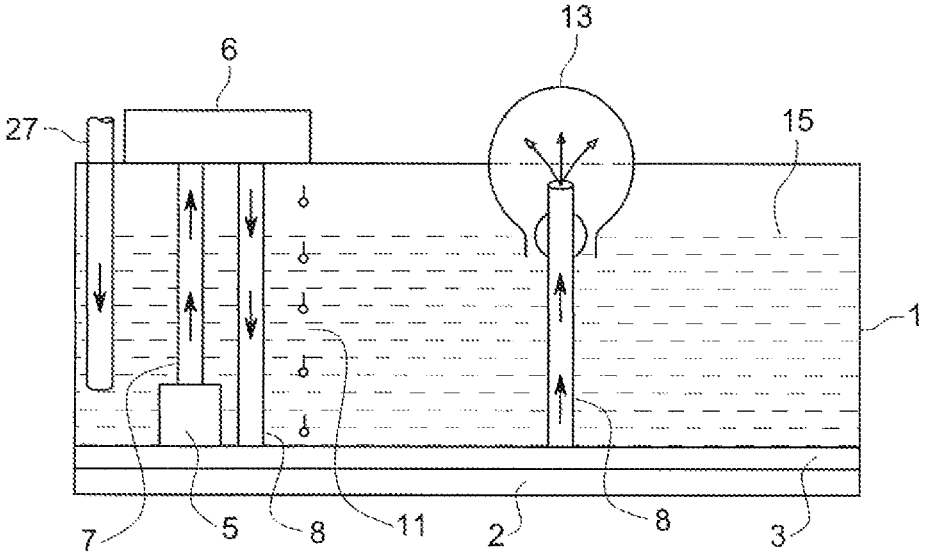
FIG. 3 illustrates an embodiment of a side view of a hydromechanical display device.

FIG. 3 illustrates a side view of a hydromechanical display device including the reservoir 1, the panel of sub-reservoir LEDs 2, the constant pressure compartment 3, the pump 5, the upper pressure chamber 6, the pressure chamber tube 7, the lower channel tube 8, the curtain of cavitation bubbles 11, the reservoir fountain tube 12, the sphere 13, and the reservoir liquid 15 in the reservoir 1. In addition, arrows point towards the flow of liquid through the various tubes in the device.

Figure 4:
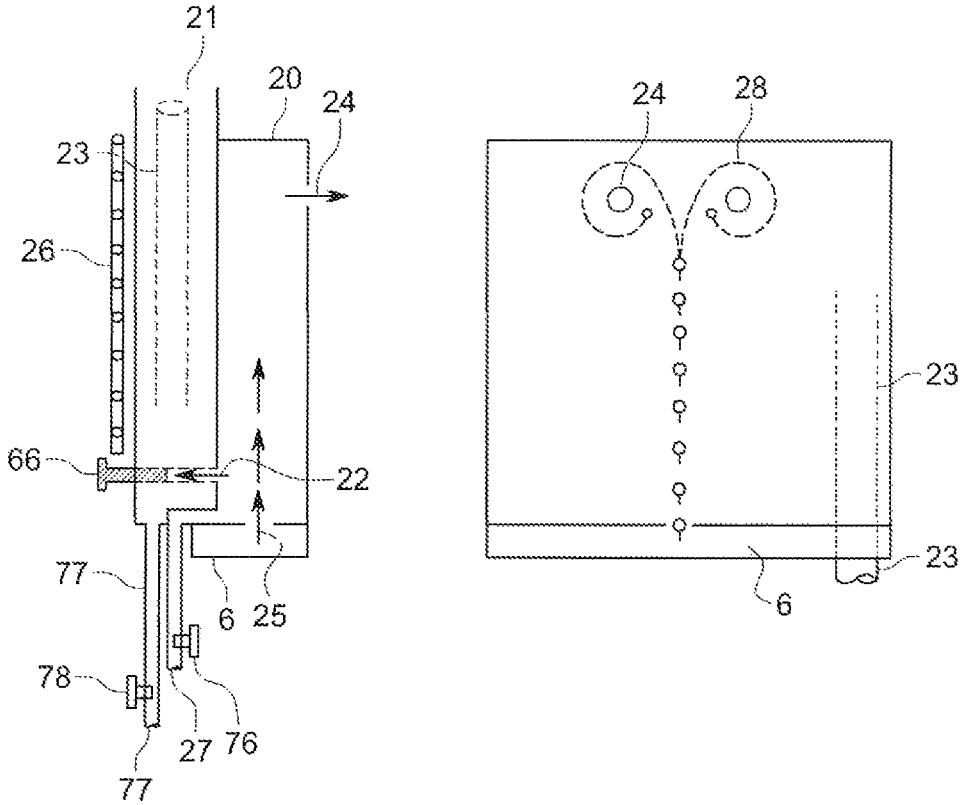
FIG. 4 illustrates an embodiment of a lateral and front view of a variable pressure module.

FIG. 4 illustrates a lateral and front view of a variable pressure module (VPM), which can be plugged into the plug-in receptacle 9 disposed above the upper pressure chamber 6. The VPM module can function concurrently with a central reservoir display, e.g. sphere 13 (not shown). As shown in this figure, liquid can be drawn up through an inflow of liquid 25 from the upper pressure chamber 6 through the plug-in receptacle 9 to a VPM chamber 20 of the VPM. An adjacent chamber 21 can be filled with liquid from VPM chamber 20 via portal 22 located in a lower portion of chambers 20 and 21, respectively.

Adjacent chamber 21 can contain a self-priming siphon 23. When liquid in adjacent chamber 21 reaches a predetermined level, the siphon 23 drains chamber 21 directly into reservoir 1. Thereafter recycling continues. With the exception of a small volume of pressure sensitive air bubbles in VPM chamber 20, the volume of this chamber is virtually a constant while the pressure is variable. At least one small pluggable portal 24 can be placed in the top of VPM chamber 20 to allow air trapped in the apex of this chamber to escape after the initial filling with liquid. Further, the portals provide liquid jets that can propel rotating discs positioned with a flexible memory rod.

By contrast, adjacent chamber 21 is a variable volume and variable hydrostatic pressure chamber, which offers a range of pressure from zero and higher up to a level proportional to the height of chamber 21. VPM chamber 20 provides a pressure that varies but remains positive throughout its cycle exceeding the hydrostatic pressure as measured by the height of chamber 20.

Tube 27 provides pressure from VPM chamber 20 to the variable pressure compartment 4 and is under the control of valve 76.

Tube 77 provides pressure from chamber 21 to the variable pressure compartment 4 and is under the control of valve 78.

Hence, depending upon the settings of the control valves 76 and 77, the pressure in the variable pressure compartment 4 may be a combination of chamber's 21 and 20 or the pressure from either chamber alone. The choice would determine the desired function of the plug-in modules. The additional hydrostatic pressure from the base of the VPM to the variable pressure compartment 4 is essentially cancelled by the height from the lower channel to the portal of the plug-in module which it supplies.

An adjustable valve 66 can also be employed to regulate the cross-sectional area of portal 22 and therefore, the rate of filling of chamber 21 and as a consequence, the cycle period of the variable pressure chamber. Thus, the user with easy access to the control valves 66,76 and 78 can control the cycle period, the speed and the volumetric flow of the plug-in modules.

The variable pressure module 4 is an integral part of the visual display. For example, the rising tide of liquid in the siphon chamber 21 with eye catching undulating waves is very relaxing. When the liquid in chamber 21 is rising, the liquid 15 in reservoir 1 is decreasing. By design, the level of the liquid in the reservoir is allowed to descend below an upper inlet of the pump 5 when the siphon is approximately 90 percent charged. At this point the pump delivers a mixture of liquid and small bubbles to chamber 20. These bubbles can appear as an explosive burst of a midline bubble geyser, which expands vertically and laterally as swirling bubble vortices exiting via the chamber's portals 24. The bubble geyser fades when the siphon discharge phase begins and the reservoir water rises. The bubbles can be multicolored by virtue of the panel of LEDs 26. An additional feature of entertainment is the development of large cavitation bubbles that are sucked into the siphon during the transition from the discharge to the charge phase of the siphon. The siphon bubbles are swept through the curved siphon channel and sparkle when illuminated by the panel of LEDs 26 behind chamber 21.

Figure 5:
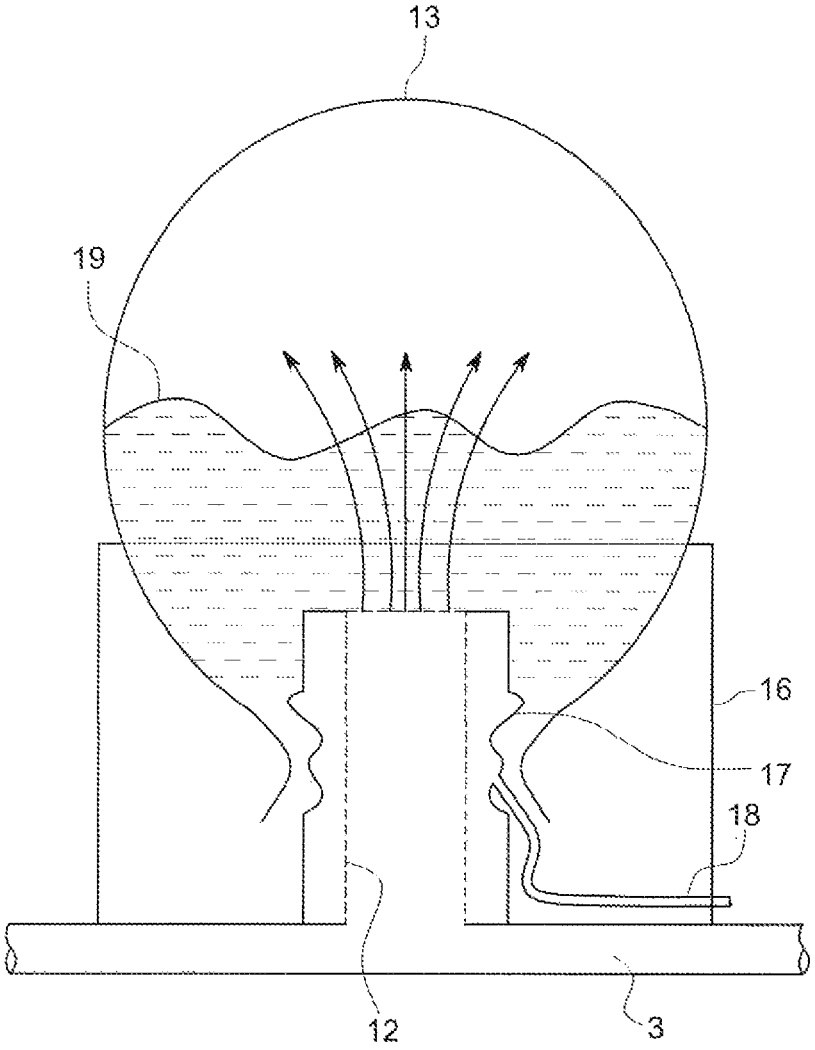
FIG. 5 illustrates an embodiment of another plug-in module.

FIG. 5 illustrates another embodiment of a plug-in module. As shown in this figure, sphere 13 rests on an acrylic sphere mount 16. The reservoir fountain tube 12 can be plugged into the constant pressure compartment 3 of the lower channel, which supplies water to the sphere 13. A donut shaped balloon 17 can be positioned on the upper portion of tube 12 at the level of the sphere's opening or orifice. The balloon 17 can be connected by tubing 18 to the variable pressure compartment 4 of the lower channel. Thus, the balloon behaves as a variable obstruction to the sphere's outflow of liquid. Hence, the liquid features within the sphere can cycle between the patterns shown in FIGS. 6, 7 and 8, and will do so synchronously with the cycles of the variable pressure compartment 4 of the lower channel.

Figure 6:
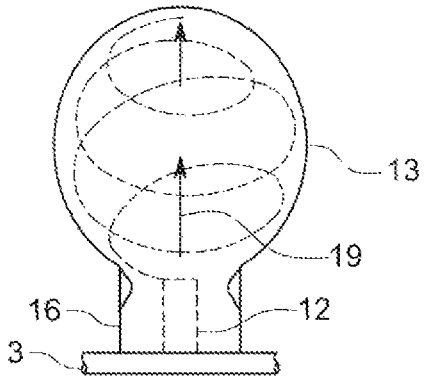
FIG. 6 illustrates an embodiment of intra-spheric liquid features through a low-grade obstruction to a sphere's outflow.

FIG. 6 illustrates a further example of intra-spheric liquid features through a low-grade obstruction to the sphere's outflow. As shown in this figure, the sphere 13 initially does not contain any liquid. The inflow of liquid from reservoir fountain tube 12 rises unencumbered in a jet-like stream to strike the upper inner surface of the sphere, in which the liquid subsequently spirals downward towards the fountain tube. At first glance, it appears as though the sphere is spinning.

Figure 7:
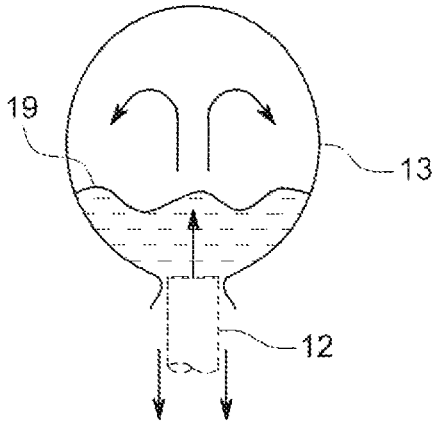
FIG. 7 illustrates an embodiment of intra-spheric liquid features through moderate obstruction to a sphere's outflow.

FIG. 7 illustrates another example of intra-spheric liquid features through moderate obstruction to the sphere's outflow. As shown in this figure, the intra-spheric body of liquid increases and impedes the velocity of the jet-like inflow of liquid from reservoir fountain tube 12. The jet-like inflow of liquid now rises like a geyser to approach the top of the sphere 13 and fall back to the surface of undulating intra-spheric liquid 19.

Figure 8:
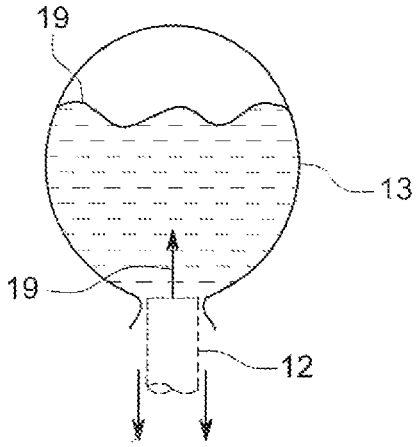
FIG. 8 illustrates an embodiment of intra-spheric liquid features through maximum obstruction to a sphere's outflow.

FIG. 8 illustrates yet another example of intra-spheric liquid features through maximum obstruction to the sphere's outflow. The jet-like stream of liquid from reservoir fountain tube 12 can be invisibly embedded in a body of undulating intra-spheric water 19 that accumulates to balance the sphere's inflow and outflow. In this phase of the sphere's cycle, the dynamic body of undulating liquid appears to have no visible means of propulsion to explain its existence.

In order to augment the entertainment value of the hydrodynamics some mechanical features were added to the displays.

Figure 9:
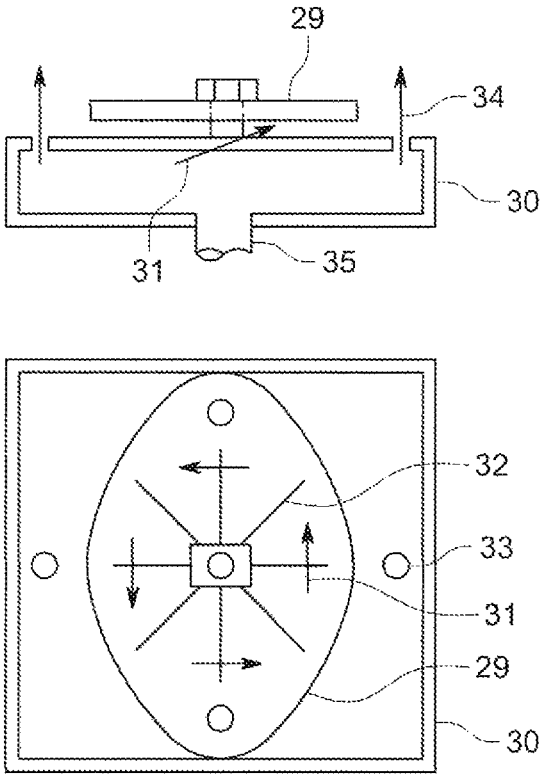
FIG. 9 illustrates an embodiment of a plug-in module.

FIG. 9 illustrates another embodiment of a plug-in module. As shown in this figure, an acrylic disc 29 can be mounted on a small pressure chamber 30. A plug 35 on the pressure chamber 30 can be connected to a receptacle in the constant pressure chamber 3 of the lower channel. The acrylic disc 29 can be propelled through rotation by the pressure chamber's liquid jets 31 directed perpendicularly to the radii of the disc's undersurface. Conveniently, ⅛-inch diameter acrylic rods 32 can be mounted radially along the disc's undersurface. The rods serve as vanes for propulsion as well as reflectors of light from a panel of multicolored LEDs 2 and 26. This results in the production of colorful glittering silhouettes on ceilings and walls of the surroundings. Four portals 33 in the pressure chamber 30 can be arranged approximately 90 degrees apart to produce geysers 34. The disc 29 can be oval shaped and designed such that the major axis of the disc interrupts two geysers at a time. Thus, this system offers two sets of pulsating geysers approximately 90 degrees apart. The accumulated surface water on the acrylic disc and small pressure chamber 30 flows into the reservoir 1 resulting in a gentle waterfall visible to the viewer. This effect occurs with the description of all the following modules.

Figure 10:
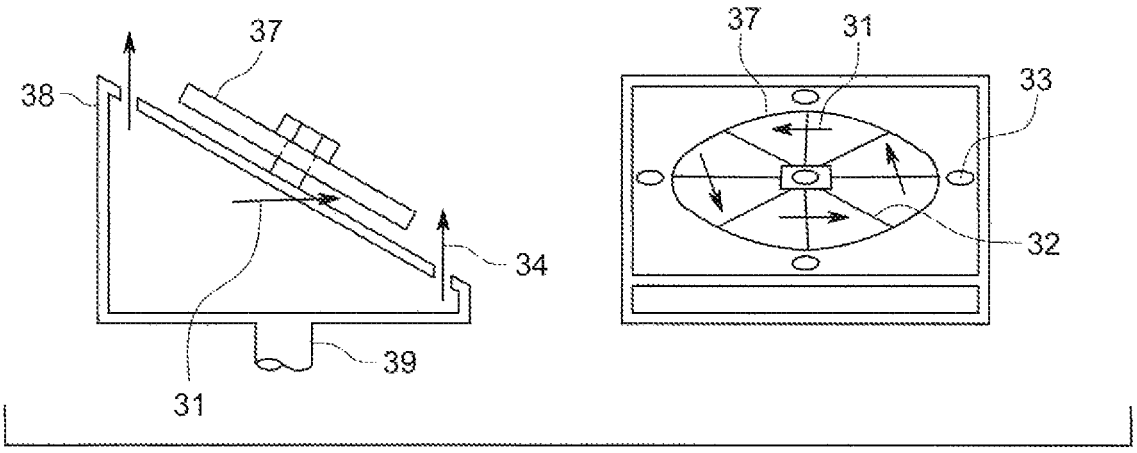
FIG. 10 illustrates another embodiment of a plug-in module.

FIG. 10 illustrates another embodiment of a plug-in module. As shown in this figure, a circular acrylic disc 37 can be mounted on a pressure chamber 38 with an approximately 30 to 45-degree angle surface. In this case, the disc 37 can be mounted at an approximately 30 to 45-degree angle in order to capture the eye of the observer at various distances and angles. Otherwise, the details of design and disc propulsion are the same as described for those in FIG. 9 with the exception of the pressure chamber plug 39, which is connected to a receptacle in the variable pressure compartment 4 of the lower channel. Thus, the rotational speed of the disc and the volume of the geyser 34 varies with the cycles of pressure in the variable pressure compartment 4.

Figure 11:
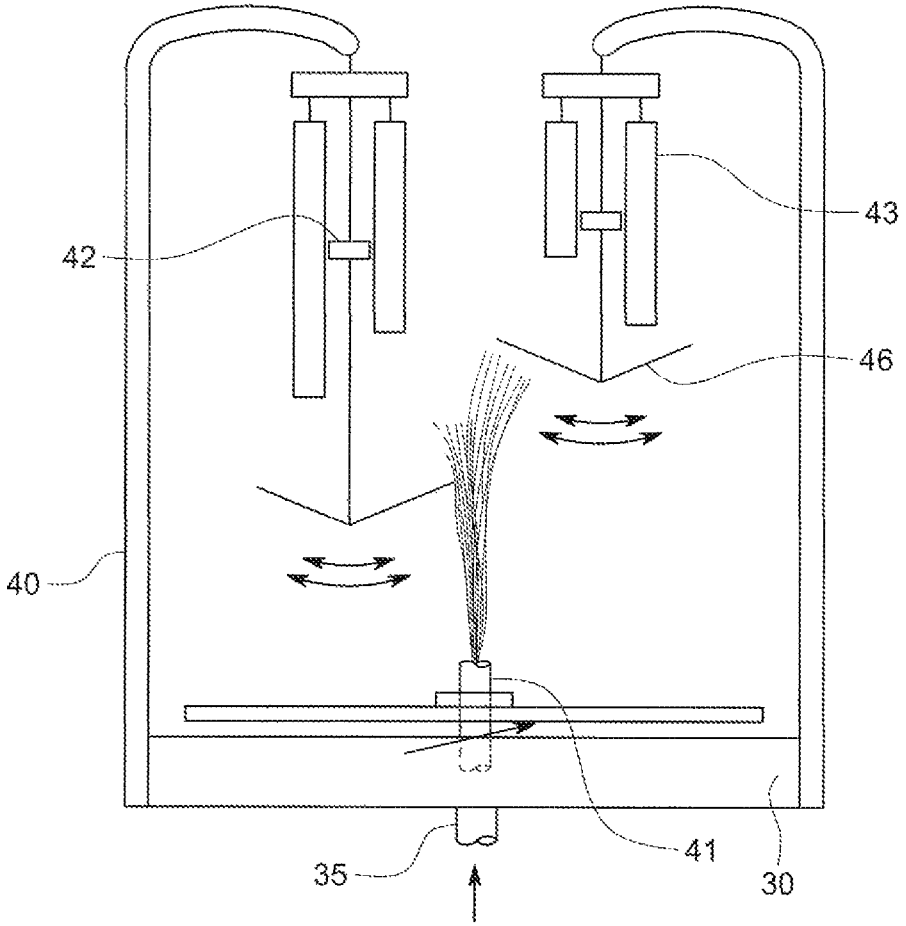
FIG. 11 illustrates another embodiment of a plug-in module.
Figure 12:
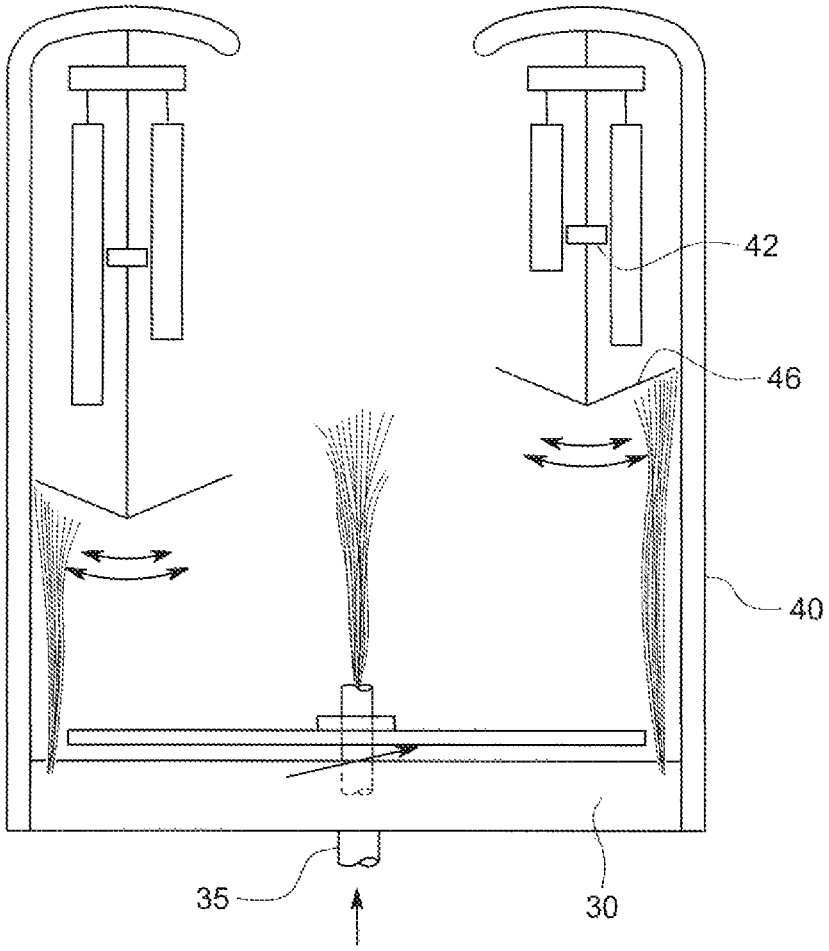
FIG. 12 illustrates another embodiment of a plug-in module.
Figure 13:
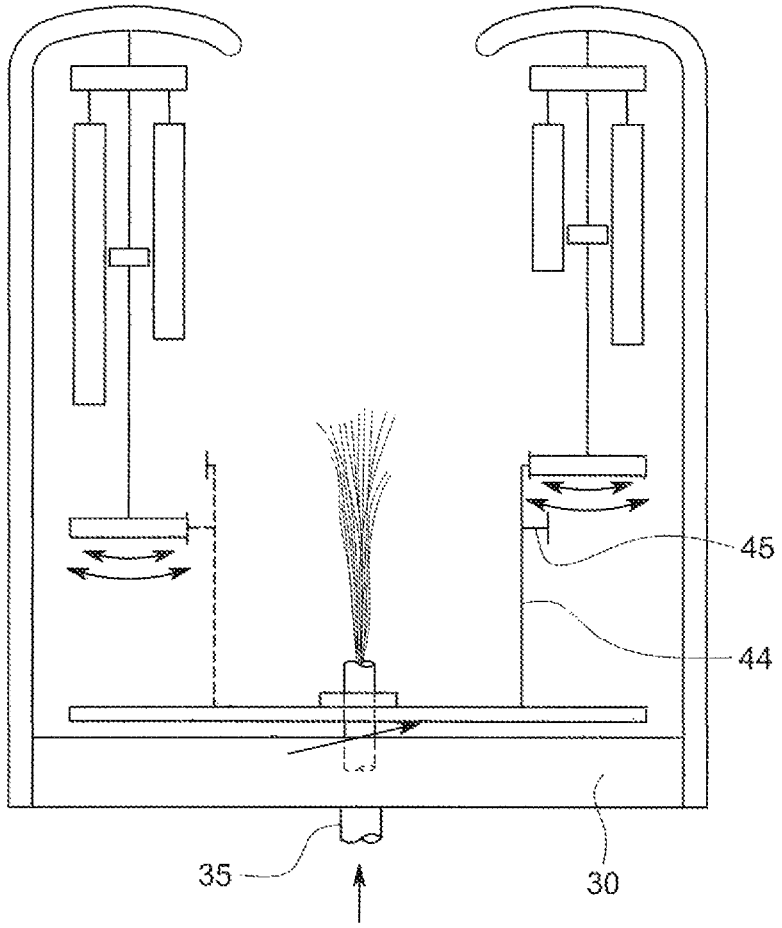
FIG. 13 illustrates another embodiment of a plug-in module.

FIGS. 11, 12, and 13 illustrate further embodiments of a plug-in module. As shown in these figures, the sweet sounds of chimes or bells can be incorporated into the rotating disc modules. The double attraction of musical sounds generated by the chimes and the mesmerizing appearance of the pendulum motion of their clappers is a significant addition to the festive character of the system.

Illustrated in FIGS. 11,12 and 13 are chimes suspended from an acrylic arch 40 mounted on a side of a pressure chamber designed with a rotating disc and a central geyser arising through tube 41.

In FIG. 11, the pressure chamber's plug 35 is inserted into the variable pressure compartment 4 of the lower channel. Thus, the volume of the central geyser and the rotational speed of the disc will vary with the variable pressure. Consequently, the geyser as shown in FIG. 11 will activate clapper 42 and chimes 43 intermittently. The intermittency of the chiming simulates more closely the serene sounds of a wind chime.

FIG. 12 illustrates the chime configuration of the rotating oval disc shown in FIG. 9 and as previously described the lateral geysers are pulsatile and will therefore activate the chimes intermittently.

FIG. 13 illustrates an acrylic rod 44 (⅛ inch diameter) mounted vertically on a rotating disc. The vertical rod is fixed with two short horizontal rods 45 (⅛ inch diameter)

positioned at different heights to activate the clapper that corresponds to the height of the horizontal rod as shown in the FIG. 13. Once again, the chimes ring intermittently with each rotation of the disc.

Figure 14:
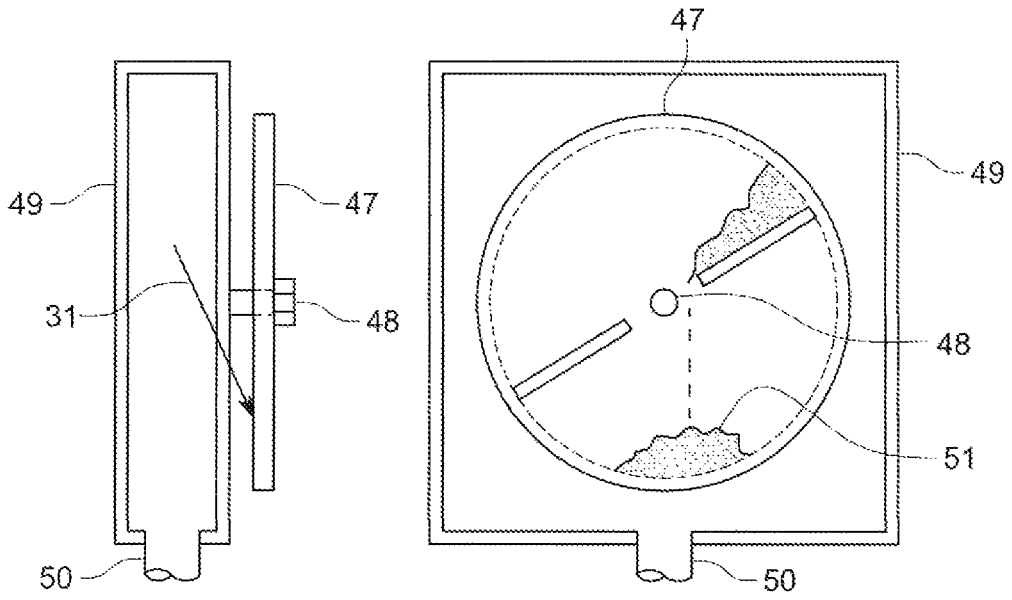
FIG. 14 illustrates another embodiment of a plug-in module.

FIG. 14 illustrates a further embodiment of a plug-in module having a rotating sand disc. As shown in this figure, a solid circular acrylic disc (1.5 in. dia.) can be overlaid with an acrylic rim (1.5 in. o.d.×1.4 in. i.d.×0.125 i.n. thick). The rim can be aligned with two 0.125 in. acrylic rods along its radius. The rods are separated by a 0.375 in. gap to allow the passage of sand. The rim-rod structure is covered with a second solid circular disc (1.5. in. dia.). Prior to closure of the sand disc, it is partially filled with decorative sand or 1/16 in. multicolored beads. The sand disc 47 rotates on a central 1/8-inch acrylic rod 48. The sand disc axil 48 can be mounted to a pressure chamber 49 as shown. The plug for this pressure chamber 50 can be connected to the constant pressure compartment 3 of the lower channel. The acrylic rod vanes and pressure chamber jets for the sand disc are similar in design and function as described for the rotating acrylic disc, see FIG. 9. The 1/16 in. glass beads are a superb alternative to the decorative sand.

Figure 15:
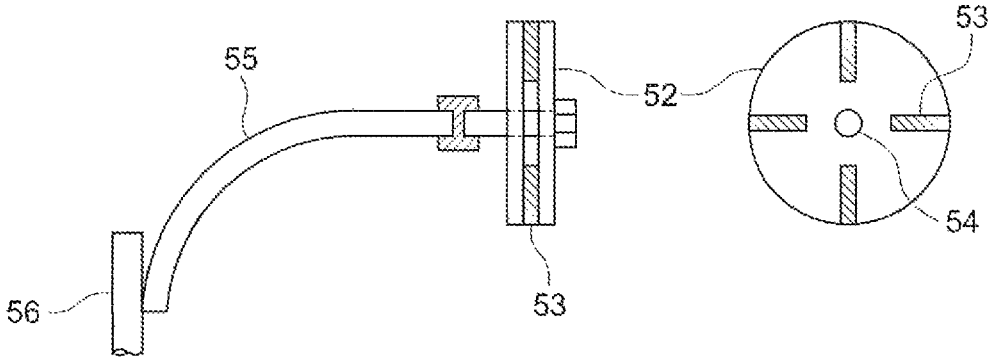
FIG. 15 illustrates another embodiment of a plug-in module.

FIG. 15 illustrates a further embodiment of a plug-in module. As shown in this figure, two discs 49 can be connected by 1/8-inch diameter acrylic rods 51. The rods serve as vanes for propulsion by the jets from portal 24 in chamber 20, see FIG. 5. The discs rotate on an acrylic axil 54. The discs are supported by a flexible memory rod 55 attached to the side of chamber 20. Thus, the discs can be positioned by the observer for optimal rotation of the discs. The satellite droplets spun off by the disc glow brilliantly when illuminated by the LEDS. A single LED or an array of LEDS can be placed on a flexible memory rod to highlight specific features of the display.

Figure 16:
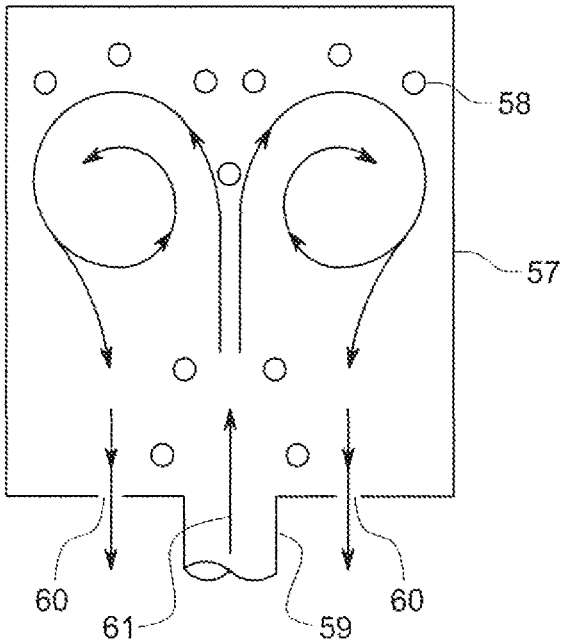
FIG. 16 illustrates another embodiment of a plug-in module.

FIG. 16 illustrates a further embodiment of a plug-in module. As shown in this figure, a bead chamber 57 can be partially filled with multicolored acrylic beads 58. The chamber 57 is connected to the variable pressure compartment 4 of the lower channel via plug 59 to provide chamber inflow 61. Portals 60 provide for the bead chamber outflow. The upward inflow 61 intermingles with the downward outflow 60 to create multiple vortices and swirls embodied in the bead chamber's body of water. These vortices and swirls are revealed by the kinetics of the beads 58, which are propelled in graceful random multidirectional vertical and lateral swirls very closely simulating the movements of fish in a bowl. In fact, the bead chamber serves well as a reasonable surrogate for a maintenance free fish bowl. The variable inflow of the bead chamber results in the chamber's water surges which consequently accentuates the randomness of the beads movements. The outflow jets from portals 60 generate columns of cavitation bubbles in the reservoir water 15. The outflow jet velocities vary with the hydrostatic pressure of the bead chamber and consequently the audial frequencies of the cavitation bubbles are variable. The cavitation bubbles are illuminated by the sub-reservoir LEDs and offer a significant contribution to the aesthetics of the display. An advantage of this module is the user's easy access to the beads and therefore, they may select the color of beads that correlate with a particular season or whatever their mood calls for.

Figure 17:
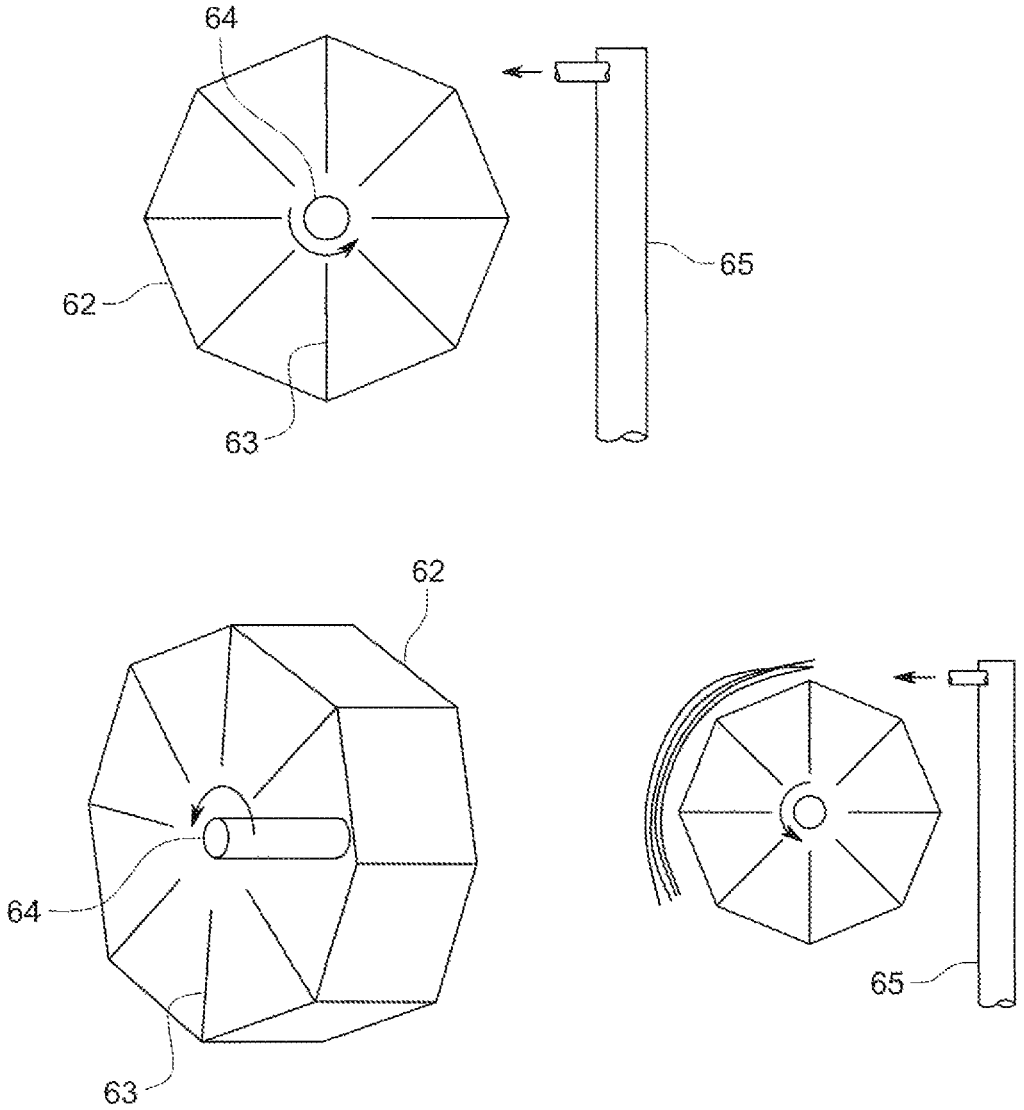
FIG. 17 illustrates another embodiment of a plug-in module.

FIG. 17 illustrates a further embodiment of a plug-in module having a multifaceted framework of a waterwheel (ww) display. As shown in this figure, the facets of the ww offers a canvass for a wide range of decorative designs composed of colorful reflective beads, mosaic glass and styled mirror chips. Two octagonal acrylic plates 62 can be positioned as ww side walls between which are placed partitions 63. The ww rotates on an acrylic rod 64 powered by a water jet from tube 65, which is plugged into a receptacle in the constant pressure compartment 4 of the lower channel. Tube 65 can be positioned on the posterior side (a non-viewer's side) of the ww and its flow creates an avalanche of "tumbling waterfalls" on the viewer's side. A mosaic of decorative small rectangular mirrors can be attached with a liquid plastic or fiberglass, e.g. Castolite, to the outside surface of the octagonal plates and the entire display is illuminated with multicolored LEDs positioned below the water reservoir 1 and highlighted by LEDs positioned on a flexible memory rod.

Figure 18:
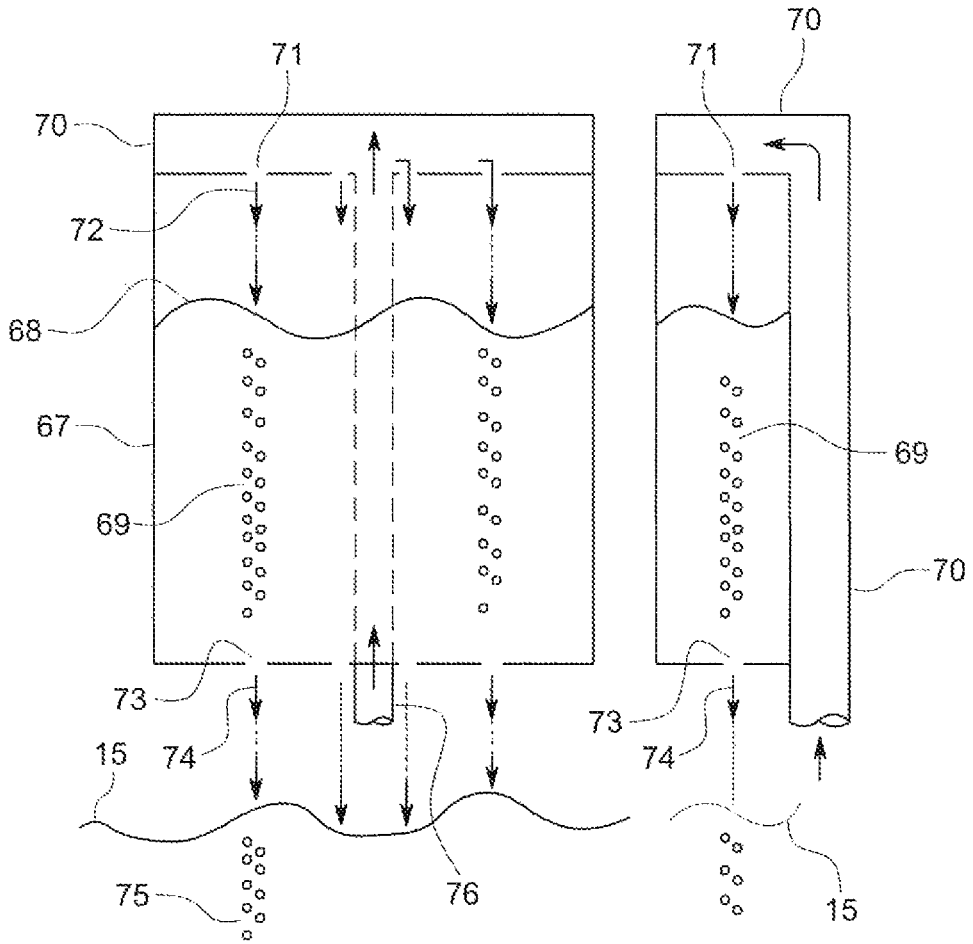
FIG. 18 illustrates another embodiment of a plug-in module.

FIG. 18 illustrates a further embodiment of a plug-in module. As shown in this figure, plug-in module includes a "tide chamber" (TC 67) with cycles in water levels 68 and cavitation bubbles 69. Disposed at the top of the tide chamber is a variable flow channel and tube 70, which can be plugged into the variable pressure compartment 4 of the lower channel. Portals 71 in the under surface of the variable flow channel 70 deliver variable velocity outflow jets 72 to the tide chamber water 68 to generate the cavitation bubbles 69. Portals 73 in the bottom of the tide chamber 67 allow variable velocity outflow jets 74 driven by the variable hydrostatic pressure of the tide chamber. The outflow jets 74 enter the reservoir water 15 and generate cavitation bubbles 75. Both the tide chamber and reservoir cavitation bubbles broadcast changing audial frequencies and when illuminated with multicolored LEDs offer a pleasing display.

Figure 19:
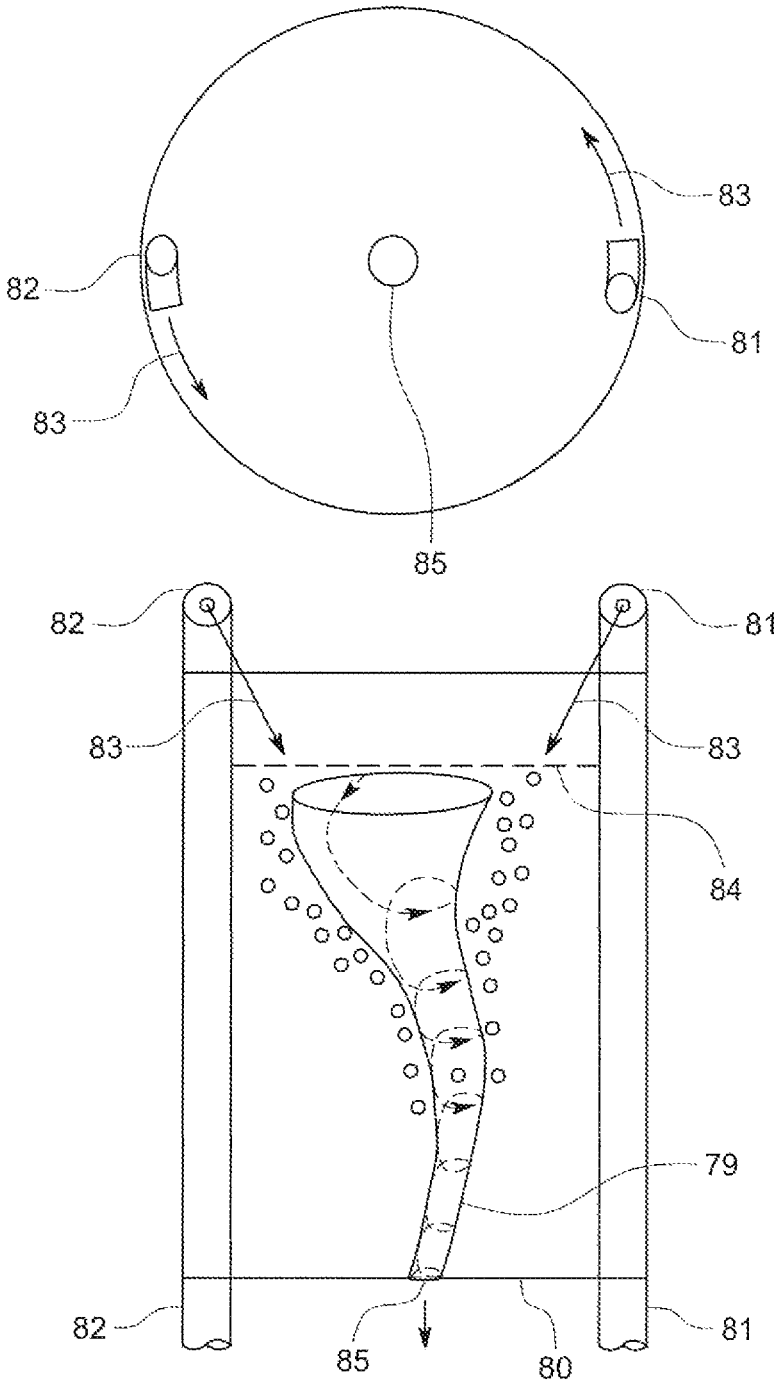
FIG. 19 illustrates another embodiment of a plug-in module.

FIG. 19 illustrates a further embodiment of a plug-in module having a well-established water funnel 79 feature in a cylinder 80. As shown in this figure, tube 81 can be plugged into the constant pressure compartment 3 of the lower channel. Tube 82 is interconnected with tube 81 just above the lower channel. Tubes 81 and 82 generate jets 83 approximately 3 cm. above the surface of the water 84 in the cylinder. The jets are directed at approximately a 45 degree angle to the surface water and substantially parallel to the circumference of the cylinder. The jets produce cavitation bubbles that adhere to the envelope of the funnel and spiral downward to the exit portal 85. The entire display can be illuminated with laser like sub-reservoir LEDs and highlighted by LEDs positioned on a flexible memory rod. What is unique to this display is the enhancement of the funnel's envelope by the delicate cavitation bubbles that glow with the LEDs illumination.

Figure 20:
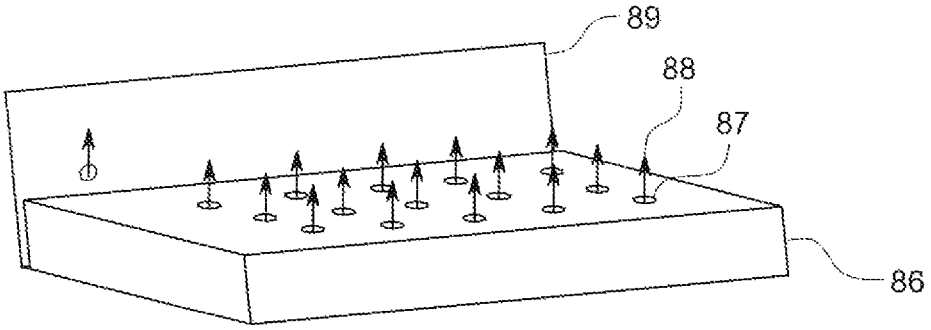
FIG. 20 illustrates another embodiment of a plug-in module.

Finally, FIG. 20 illustrates an embodiment of a plug-in module having a pressure chamber 86 with an upper surface fenestrated with 1/16-in. portals 87 to generate a panel of multiple micro geysers 88. The micro geysers can be illuminated by the sub-reservoir LEDs and sparkle brilliantly either continuously if the pressure chamber 86 is plugged into the constant pressure compartment 3 of the lower channel or intermittently if plugged into the variable pressure compartment 4 of the lower channel. The pressure chamber can also be backed with an "infinity mirror" 89.

While the inventive features have been particularly shown and described with reference to preferred embodiments thereof, it will be understood by those in the art that the foregoing and other changes may be made therein without departing from the spirit and the scope of the disclosure. Likewise, the various diagrams may depict an example architectural or other configuration for the disclosure, which is done to aid in understanding the features and functionality that can be included in the disclosure. The disclosure is not restricted to the illustrated example architectures or configurations but can be implemented using a variety of alternative architectures and configurations. Additionally, although the disclosure is described above in terms of various exemplary embodiments and implementations, it should be understood that the various features and functionality described in one or more of the individual embodiments are not limited in their applicability to the particular embodiment with which they are described. They instead can be applied alone or in some combination, to one or more of the other embodiments of the disclosure, whether or not such embodiments are described, and whether or not such features are presented as being a part of a described embodiment. Thus, the breadth and scope of the present disclosure should not be limited by any of the above-described exemplary embodiments.

What is claimed is:

1. A hydromechanical display device, comprising:

a reservoir for containing liquid;

at least one pump disposed within the reservoir;

an upper pressure chamber having a plurality of openings and located above the reservoir, wherein the pump is connected to and is in fluid communication with the upper pressure chamber through a pressure chamber tube;

a plug-in receptacle containing a plug-in variable pressure module located on a top side of the upper pressure chamber, wherein the upper pressure chamber is connected to and is in fluid communication with the plug-in receptacle and plug-in variable pressure module, wherein the plug-in variable pressure module includes a variable pressure and constant volume chamber, which is connected to and is in fluid communication with a directly adjacent variable volume and variable hydrostatic pressure chamber;

a control valve for controlling flow from the variable pressure and constant volume chamber to the variable volume and variable hydrostatic pressure chamber;

a lower channel including a constant pressure compartment and a variable pressure compartment located below the reservoir, wherein the upper pressure chamber is connected to and is in fluid communication with the constant pressure compartment through a lower channel tube, and wherein the plug-in variable pressure module is connected to and is in fluid communication with the variable pressure compartment through one or more tubes.

2. The hydromechanical device of claim 1, further comprising a self-priming siphon disposed in the variable hydrostatic pressure variable volume chamber of the plug-in variable pressure module.

3. The hydromechanical device of claim 1, wherein a bottom panel of the upper pressure chamber has a semi-rectangular array of openings.

4. The hydromechanical device of claim 1, further comprising at least one control valve on the one or more tubes connecting the plug-in variable pressure module with the variable pressure compartment.

5. The hydromechanical device of claim 1, further comprising one or more plug-in modules, wherein the one or more plug-in modules are connected to and are in fluid communication with the constant pressure compartment or the variable pressure compartment through one or more reservoir tubes.

6. The hydromechanical device of claim 5, wherein the one or more plug-in modules is an open-ended sphere for outflow of liquid.

7. The hydromechanical device of claim 6, further comprising:

an acrylic sphere mount for supporting the sphere; and a donut shaped balloon surrounding an upper portion of one of the one or more reservoir tubes at a level of the sphere's opening.

8. The hydromechanical device of claim 7, wherein the donut shaped balloon is connected to and is in fluid communication with the variable pressure compartment through a tube.

9. The hydromechanical device of claim 8, wherein the variable pressure within the donut shaped balloon provides a variable obstruction to the sphere's outflow of liquid.

10. The hydromechanical device of claim 5, wherein the one or more plug-in modules includes a rotating acrylic disc with reflections of colorful glittering silhouettes on the ceilings and walls of the surrounding.

11. The hydromechanical device of claim 5, wherein the one or more plug-in modules includes a rotating acrylic disc, pulsating geysers and musical chimes.

12. The hydromechanical device of claim 5, wherein the one or more plug-in modules includes an acrylic bead chamber, which serves as a surrogate for a maintenance free fish bowl.

13. The hydromechanical device of claim 5, wherein the one or more plug-in modules includes a colorful rotating sand/bead discs and rotating water wheels.

14. The hydromechanical device of claim 5, wherein the one or more plug-in modules includes a water funnel with cavitation bubbles that adheres to an envelope of the funnel and are illuminated by laser like light emitting devices (LEDs).

15. The hydromechanical device of claim 5, wherein the one or more plug-in modules includes a panel of micro geysers that are illuminated with a sub-panel of LEDs.

* * * * *